United States Patent [19]

Robinson

[11] 4,318,475

[45] Mar. 9, 1982

[54] ASPHALT CONTAINER

[75] Inventor: J. Ronald Robinson, Mesa, Ariz.

[73] Assignee: Crafco, Inc., Chandler, Ariz.

[21] Appl. No.: 148,460

[22] Filed: May 9, 1980

[51] Int. Cl.[3] ..... B65D 85/00

[52] U.S. Cl. ..... 206/447; 206/526; 206/524.3

[58] Field of Search ..... 206/447, 526, 524.3; 229/53, 3.5 R, 15; 150/1

[56] References Cited

U.S. PATENT DOCUMENTS

| | | | |
|---|---|---|---|
| 1,666,730 | 4/1928 | Breeze, Jr. | 206/447 |
| 2,083,479 | 6/1937 | Speare | 106/526 |
| 2,572,959 | 10/1951 | Sparks | 206/447 |
| 3,570,749 | 3/1971 | Sato et al. | 150/1 |

FOREIGN PATENT DOCUMENTS

| | | | |
|---|---|---|---|
| 1125803 | 11/1956 | France | 206/524.3 |

*Primary Examiner*—William T. Dixson, Jr.
*Attorney, Agent, or Firm*—Herbert E. Haynes, Jr.

[57] ABSTRACT

A container for receiving molten asphalt for subsequent use at a job site includes a cardboard having a bag-shaped liner therein for receiving and containing the molten asphalt. The bag-shaped liner has special properties which are conducive to an efficient asphalt containerization process and are compatible with the requirements for handling and preparing the asphalt for use at the job site.

10 Claims, 6 Drawing Figures

ASPHALT CONTAINER

BACKGROUND OF THE INVENTION

1. Field of the Invention

This invention relates to containers and more particularly to special containers for asphalt and asphalt compositions.

2. Description of the Prior Art

As is well known in the art molten asphalt is employed for various jobs in the construction arts such as for seal coating roadways, runways and the like, and also for comparatively small jobs such as the filling of cracks and expansion joints in paved surfaces, and various spot applications such as on paved surfaces, roofs, and the like.

In the relatively large jobs, such as the above mentioned seal coating of paved surfaces, where large quantities of molten asphalt are to be used, the molten asphalt is placed in special transport trucks at the asphalt plant and delivered directly to the job site where it is transferred either to interim storage tanks or directly to heated spray applicator trucks. In some instances, the molten asphalt is mixed at the job site with special additives such as shredded rubber, prior to being applied to the paved surface. At any rate, such a procedure must be accomplished rather rapidly to prevent excessive cooling of the molten asphalt, to keep the needed interim storage facilities to a minimum, and to keep equipment and labor costs to a minimum. Even when this procedure is most efficiently accomplished, it is an expensive matter and as such cannot be economically justified on the comparatively smaller jobs due to the smaller quantities of materials needed, the slow and often interrupted application schedules and the like.

Therefore, it is common practice to place molten asphalt, or molten asphalt compositions, in manually handleable containers at a manufacturing facility and ship the desired quantity to a job site on an as needed and when needed basis. When the asphalt is needed at a job site, the containers are torn open and the asphalt, which has since cooled and thus, solidified, is placed in a heating vessel which is usually a tank which is an integral part of the mechanism which is to be used to apply the asphalt. When the desired temperature of the molten asphalt is reached, normally a minimum of about 275° F., it is applied in accordance with procedures suitable for the particular job.

As is known, molten asphalt is a difficult material to handle due to the inherent characteristics of the material itself which, in addition to the prior art containers commonly used in the packaging thereof, makes the containerization of the molten asphalt a slow, messy and relatively costly operation.

Molten asphalt will flow at temperatures as low as about 200° F. but is very viscous at such low temperatures which makes the pumping thereof a slow and otherwise difficult task. At higher temperatures, the molten asphalt will, of course, become less viscous and thus is easier on the pumps and otherwise makes the filling of the containers a faster, easier, and less costly operation.

However, at the elevated temperatures at which the molten asphalt will more easily flow, such elevated temperatures can destroy the containers. Thus, prior art containerization of molten asphalt is accomplished at compromise temperatures, which to the best of my knowledge, have never exceeded about 225° F. without melting the containers commonly used in the art. It will be seen from the above that a limiting factor in the prior art asphalt containerization process is the container itself which requires that the asphalt be cooled from about the 350° F. temperature at which it is received from the asphalt plant to about 225° F., or lower, so that it will not destroy the containers. Such cooling can involve a considerable time delay particularly in warm climates in that such a large quantity of molten asphalt does not cool rapidly.

Therefore, due to the required cooling time and the relatively low temperatures at which the prior art containerization of molten asphalt must be accomplished, it will be seen that the prior art method is a slow and costly operation both from a labor standpoint and an equipment wear standpoint.

Another characteristic of the asphalt which must be considered in all containerization processes is that asphalt will adhere to virtually anything and upon cooling will form a very tenacious bond with the contacted item. This inherent characteristic of asphalt has dictated the basic design parameters of the containers used since the beginning of this type of containerization.

The conventional container for asphalt includes a corrugated cardboard carton into which a thin-wall bag is inserted as a liner. The thin-wall liner bag is formed of a synthetic plastic material having a wall thickness of about 0.006 inches, and the specific material heretofore used is a low density polyethylene which is capable of withstanding temperatures of up to a maximum of about 225° F. and will melt at or somewhat higher than that temperature.

When the molten asphalt is pumped into the plastic liner bags it will adhere thereto which makes subsequent removal difficult if not impossible to accomplish. Therefore, when readying the containerized asphalt for use at a job site, it is a common practice to tear open the carton, remove the plastic liner bag having the solidified asphalt therein and place it, liner bag and all, in the vessel which is to be used to heat the asphalt. Due to the nature of the plastic material, and since the mass of the plastic is small in comparison to the mass of the asphalt, the plastic will not appreciably affect the integrity of the asphalt. This common practice places further design parameters on the nature and characteristics of the plastic liner in addition to its being capable of withstanding the hereinbefore described containerization temperatures. These further considerations are that the liner bag ideally should be as thin as possible, preferably below the 0.006 inch film thickness commonly used in the prior art, and should melt at asphalt reheat temperatures of about 275° F. which is the ideal temperature at which the molten asphalt will, for example, properly flow into cracks and expansion joints in paved surfaces.

In view of the above, it will be appreciated that the plastic liner bag used for the containerization of asphalt should have as thin a wall thickness as possible to reduce contamination of the asphalt, and should be capable of withstanding temperatures as high as possible to minimize the asphalt precooling time and otherwise result in maximum containerization efficiency. Further, the material of which the plastic liner bag is formed must be completely molten at the temperature to which the asphalt is reheated at the job site for application purposes. To the best of my knowledge, no prior art asphalt container has been developed which meets these desired characteristics.

Therefore, a need exists for a new and improved manually handleable container for asphalt and asphalt compositions, which overcomes some of the problems and shortcomings of the prior art.

SUMMARY OF THE INVENTION

In accordance with the present invention, a new and improved manually handleable asphalt container is disclosed which includes a suitable cardboard enclosure means in which a plastic liner bag having specific characteristics is inserted for receiving and containing the asphalt.

The cardboard enclosure means is preferably a corrugated cardboard carton having sufficient structural strength to support the weight of the asphalt, which is normally about 60 pounds, and which is designed to have a single one of the special plastic liner bags inserted therein.

An alternate form of cardboard enclosure means is a multicompartment structure, preferably of corrugated cardboard, with each compartment designed to have one of the special plastic liner bags inserted therein.

In either case, the plastic liner bag is formed of a specific type of synthetic resin which will withstand the comparatively high temperatures needed for efficient containerization of the molten asphalt, reduce the asphalt precooling time, and will melt at the higher temperatures at which the asphalt is reheated for application purposes. More specifically, the synthetic resin of which the plastic liner bag is made is a high density polyethylene having a high density of about 0.940 grams/cm$^3$ and having a melt index of about 0.2 grams/10 minutes. Synthetic resins of this type are proprietary products, as to the specific formulation, of the various companies who manufacture them. A particular synthetic resin suitable for this purpose is available from the Gulf Oil Co. and is identified as product number 9640-T. The resin may be extruded into the desired liner bag configuration by various plastic manufacturing concerns such as the Rainbow Manufacturing Co., 5160 W. Missouri Ave., Phoenix, Ariz.

In addition to the above described temperature characteristics of the specific desired synthetic resin, the resin produces a liner bag with the additional advantages of a minimum wall thickness of about 0.003 inches, is easier to handle, i.e., open, in comparison with the prior art liner bags, and is highly tear resistant.

Accordingly, it is an object of the present invention to provide a new and improved container for asphalt and asphalt compositions.

Another object of the present invention is to provide a new and improved container for asphalt which includes a cardboard enclosure means in which at least one liner bag is inserted for receiving the molten asphalt and containing it in a manually handleable package.

Another object of the present invention is to provide a new and improved container for molten asphalt of the above described character wherein the liner bag is formed of a synthetic resin which is capable of being extruded or otherwise formed into the desired bag shaped configuration to provide an easily handled liner having minimum wall thickness.

Another object of the present invention is to provide a new and improved container for molten asphalt of the above described character wherein the liner bag is formed of synthetic resin which is capable of withstanding relatively high temperatures so as to reduce the required precooling time of the received molten asphalt.

Another object of the present invention is to provide a new and improved container for molten asphalt of the above described character wherein the liner bag is formed of a synthetic resin which is capable of withstanding temperatures above 225° F. so that the molten asphalt placed therein may be at a temperature at which it will readily flow.

Another object of the present invention is to provide a new and improved asphalt container of the above described type wherein the plastic liner bag is formed of a synthetic resin which will withstand temperatures of up to approximately 265° F. for maximum efficiency of the asphalt containerization process and will become completely molten at temperatures between 270° F. and 275° F.

Still another object of the present invention is to provide a new and improved asphalt container of the above described type wherein the plastic liner bag is formed of a high density polyethylene having a melt index of approximately 0.2 grams/10 minutes, and having a density of approximately 0.940 grams/cm$^3$.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
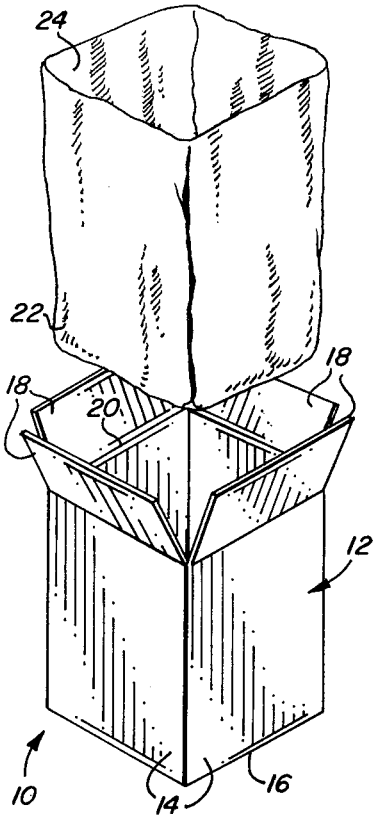
FIG. 1 is an exploded perspective view illustrating the preferred embodiment of the improved asphalt container of the present invention.
Figure 2:
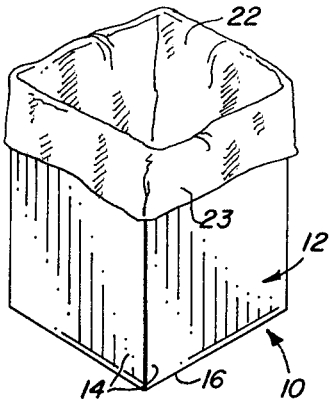
FIG. 2 is a perspective view of the container shown in FIG. 1 which is assembled and ready to receive the molten asphalt.
Figure 3:
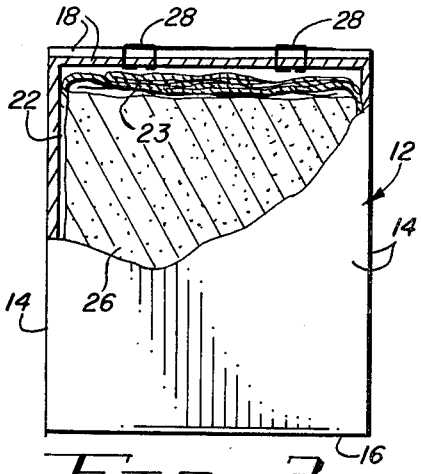
FIG. 3 is a side elevational view of the container of FIG. 1 which is partially broken away to illustrate the condition of that container as having been filled with asphalt and closed for shipment to a job site.

Referring more particularly to the drawings, FIGS. 1, 2 and 3 illustrate the preferred configuration of the asphalt container of the present invention, with this container being indicated in its entirety by the reference numeral 10.

As seen best in FIG. 1, the container 10 includes a cardboard enclosure means 12 in the preferred form of a corrugated cardboard carton having the usual upstanding sidewalls 14, closed bottom 16, and the top flaps 18 by which the open top 20 of the carton is closable in the conventional manner. The carton 12 is sized to contain a bag-shaped plastic liner 22 which is capable of containing about 60 pounds of asphalt as will hereinafter be described in detail. Therefore, the carton should be of sufficient structural strength to support the weight of such an amount of asphalt.

To prepare the container 10 for receiving molten asphalt, the plastic liner 22 is inserted therein with the portions 23 which circumscribe the top opening 24 of the bag-shaped liner being folded over the upstanding top flaps 18 of the carton 12 in the manner shown in FIG. 2.

After the proper amount of molten asphalt, as shown at 26 in FIG. 3, has been deposited in the liner bag 22, the portions 23 of the liner are folded inwardly on top of the asphalt 26 and the carton 12 is closed in any suitable manner such as with the staples 28 shown in FIG. 3.

Figure 4:
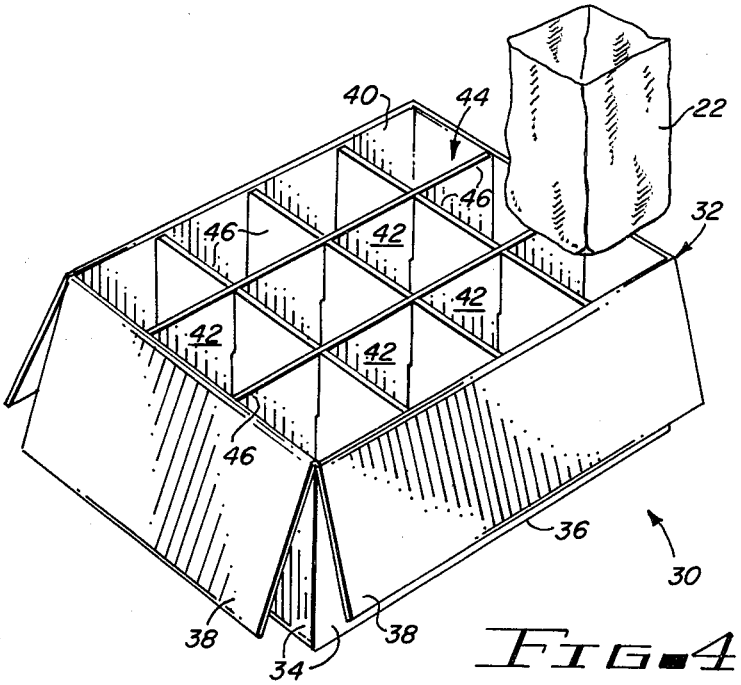
FIG. 4 is an exploded perspective view illustrating a second embodiment of the asphalt container of the present invention.
Figure 5:
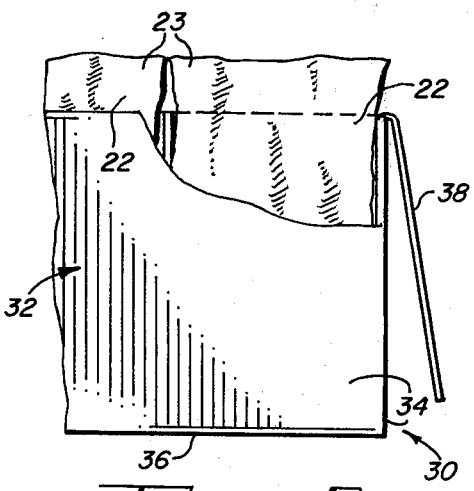
FIG. 5 is a fragmentary side elevational view of the container of FIG. 4 which is partially broken away to illustrate the various features thereof when this container is assembled and ready to receive the molten asphalt.
Figure 6:
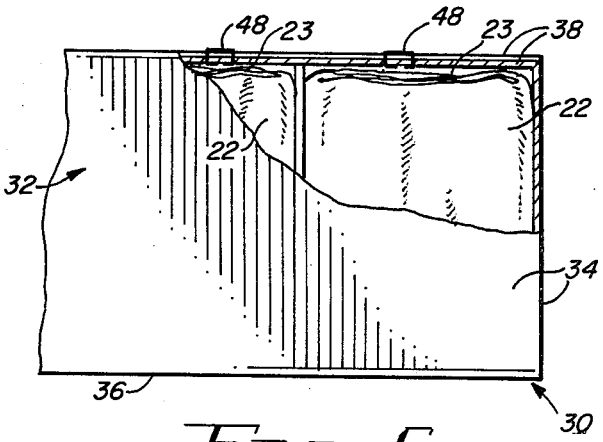
FIG. 6 is a fragmentary side elevational view similar to FIG. 5 and showing the container as having been filled with asphalt and closed for shipment to a job site.

An alternate form of asphalt container is shown in FIGS. 4, 5 and 6 with this container being indicated generally by the reference numeral 30.

As seen best in FIG. 4, the asphalt container 30 includes a cardboard enclosure means 32 in the preferred form of a corrugated cardboard carton having the usual upstanding sidewalls 34, closed bottom 36, and the top flaps 38 by which the open top 40 of the carton is closable in the normal manner. As seen, the interior of the carton 32 is divided into a multiplicity of individual compartments 42 each of which is sized to receive one of the plastic liner bags 22 in the manner hereinbefore described. The interior of the carton 32 is divided into the compartments 42 by insertion of a partition 44. The partition 44, which is also preferably formed of corrugated cardboard, is of a configuration which is sometimes referred to as an egg case, or egg crate, divider, and is provided with suitably notched divider walls 46 which are assembled in the well known manner to provide the desired configuration.

When the container 30 is prepared to receive molten asphalt each individual compartment 42 will have one of the plastic liner bags 22 inserted therein in the manner shown in FIG. 5, and after being filled with the molten asphalt 26 (FIG. 3), the liner bags are foldingly closed in the hereinbefore described fashion and the top flaps 38 of the enclosure means 32 are fixed in the closed position, such as by the staples 48 shown in FIG. 6.

As hereinbefore described, the molten asphalt is placed in the containers of the present invention at a manufacturing facility for shipment and subsequent use at a job site, and the plastic liner bags 22 should have certain physical properties and other characteristics which are compatible with both the containerization and subsequent use of the asphalt.

With regard to the containerization, the plastic liner bags 22 should be relatively easy to handle, have a minimum wall thickness, be resistant to tearing and should be of comparatively low cost. Most importantly, the plastic liner bags 22 should be capable of withstanding the temperatures at which molten asphalt is relatively easy to pump and/or otherwise handle. As is known, molten asphalt will flow at temperatures of about 200° F. but is very viscous at this temperature and will become less viscous as the temperature is increased. However, the temperature of the molten asphalt when it is being containerized is limited by the properties of the liner bags, and the properties of the liner bags are determined by factors relating to the requirements of the point of use, i.e., the job site.

As is known, molten asphalt will adhere to virtually anything that it comes in contact with and the plastic liner bags 22 are no exception. Thus, when the containerized asphalt, which has cooled and solidified subsequent to the containerization thereof, is being readied for use at the job site, the plastic liner bags along with the asphalt are placed in a suitable heating vessel which must be elevated to a temperature that not only melts the asphalt but also melts the plastic liner bags.

The temperatures to which the asphalt may be reheated at the job site, can, of course, be very high, but to save time, money, and conserve on energy, the job site reheat temperature is usually about 275° F. in that asphalt at that temperature is suitable for most purposes.

In view of the above, it will be seen that the material of which the plastic liner bags are made should be capable of withstanding the temperatures at which the molten asphalt will readily flow for efficiency of the containerization process and must melt at some temperature immediately below the job site reheat temperature.

A particular material which is ideal for this purpose is a high density polyethylene resin which is extruded, or otherwise formed into the desired bag-shaped configuration by methods well known in the art. This particular material is ideal in that the liner bags made therefrom may have a wall thickness of about 0.003 inches, are highly tear resistant, and are easy to open and otherwise handle, and are considerably less expensive than the liner bags heretofore used. Further, this particular high density polyethylene resin will begin to soften at about 267° F. which means that the molten asphalt placed in the liner bags 22 during containerization can be safely heated up to about 260° F. and at this temperature, or temperature somewhat lower, the molten asphalt can be efficiently containerized. This material will become completely molten at temperatures between 270° F. and 275° F. thus, the melting requirement at the job site is satisfied.

This material is a proprietary product of several synthetic resin manufacturing companies, one of which is the Gulf Oil Co. which markets the resin under the identification of product number 9640-T, as hereinbefore mentioned. The product 9640-T, and similar resins of other companies, have a density of about 0.940 grams/cm$^3$ and has a melt index of approximately 0.2 grams/10 minutes. The melt index is calculated by heating a given amount of the polymer to 190° C. and measuring the amount which melts and flows through a 0.130 inch diameter orifice under a pressure of 44 pounds per square inch, with the units being reported in grams/10 minutes.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A container for receiving and containing molten asphalt for subsequent use at a job site, said container comprising in combination:

(a) a rigid disposable shipping enclosure of cardboard; and (b) a bag-shaped plastic film liner in said rigid disposable shipping enclosure receiving the molten asphalt at a temperature up to about 250° F., said bag-shaped plastic film liner being formed of a material which becomes molten at temperatures in the range of from above 250° F. to about 285° F.

2. A container for receiving and containing molten asphalt for subsequent use at a job site, said container comprising in combination:

(a) a rigid disposable shipping cardboard enclosure; and (b) at least one bag-shaped liner in said enclosure receiving and containing the molten asphalt, said bag-shaped liner being formed of high density polyethylene film which is capable of withstanding molten asphalt temperatures of up to about 250° F. and will become completely molten at temperatures above approximately 250° F.

3. The combination of claim 2 wherein the high density polyethylene material of which said bag-shaped polyethylene film liner is formed becomes molten at temperatures in the range of above 250° F. to about 285° F.

4. The combination of claim 2 wherein the high density polyethylene film material of which said bag-shaped liner is formed has a density of approximately 0.940 grams/cm$^3$.

5. The combination of claim 2 wherein the high density polyethylene film material of which said bag-shaped liner is formed becomes completely molten at temperatures of between 270° F. and 275° F.

6. The combination of claim 2 wherein the high density polyethylene film material of which said bag-shaped liner is formed begins to soften at temperatures between 265° F. and 270° F.

7. The combination of claim 2 wherein the high density polyethylene film material of which said bag-shaped liner is formed has a density of approximately 0.940 grams/cm$^3$ and has a melt index of about 0.2 grams/10 minutes.

8. The combination of claim 2 wherein said rigid disposable shipping cardboard enclosure is a corrugated cardboard carton.

9. The combination of claim 2 wherein said rigid disposable shipping cardboard enclosure is a corrugated cardboard carton which is configured to contain one of said bag-shaped liners.

10. The combination of claim 2 wherein said rigid disposable shipping cardboard enclosure is a corrugated cardboard carton the interior of which is divided into a plurality of individual compartments each of which is configured to contain one of said bag-shaped polyethylene film liners.

* * * * *